United States Patent [19]

Garcea

[11] 4,105,414

[45] Aug. 8, 1978

[54] CATALYTIC MUFFLER FOR INTERNAL COMBUSTION ENGINES

[75] Inventor: Giampaolo Garcea, Milan, Italy

[73] Assignee: Alfa Romeo S.p.A., Milan, Italy

[21] Appl. No.: 751,670

[22] Filed: Dec. 17, 1976

[30] Foreign Application Priority Data

Dec. 23, 1975 [IT] Italy ..... 30747 A/75

[51] Int. Cl.[2] ..... F01N 3/15

[52] U.S. Cl. ..... 23/288 F; 60/299; 60/301; 60/303; 55/DIG. 30

[58] Field of Search ..... 23/288 F; 60/299, 303, 60/301; 55/DIG. 30

[56] References Cited

U.S. PATENT DOCUMENTS

| | | | |
|---|---|---|---|
| 3,054,664 | 9/1962 | Purse | 23/288 F |
| 3,615,255 | 10/1971 | Patterson et al. | 23/288 F |
| 3,927,984 | 12/1975 | Hartley | 23/288 F |

*Primary Examiner*—James H. Tayman, Jr.
*Attorney, Agent, or Firm*—Holman & Stern

[57] ABSTRACT

A catalytic muffler for internal combustion engines of cylindrical flattened construction having an inner casing containing the catalyst. Annular flow patterns are provided for gas entry and exit wherein the gas pressure and thus velocity remain substantially constant. The specific connections of the circular faces of the inner casing to the annular wall thereof are slip designed with the design of the outer half shells providing the holding force to keep the same in yieldable, contact throughout the various temperature changes undergone.

7 Claims, 5 Drawing Figures

CATALYTIC MUFFLER FOR INTERNAL COMBUSTION ENGINES

Figure 2:
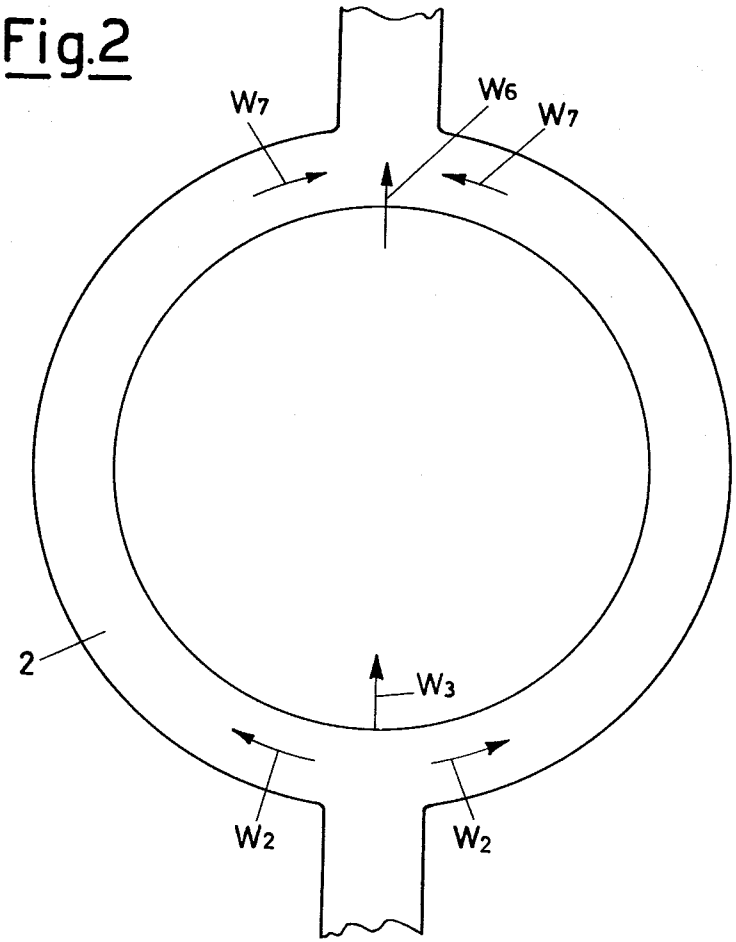

A few updated motor car types use, as is known, a catalytic muffler in which carbon monoxide and unburned hydrocarbons as contained in the engine exhaust gases are oxidized to prevent air pollution which would be experienced if the exhaust gases were directly discharged in the atmosphere.

For this automotive use, the mufflers of the catalytic type are, as is also well known, of two kinds according to whether the porous ceramic support of the catalyst metal is granular (granular support), or is composed by one or more monolithic elements having a cellular structure (monolithic support). For both types of catalyst a metallic container is required which, equipped with an inlet and an outlet duct, is inserted in a sealtight way in a portion of the exhaust pipe of the engine.

This invention relates to a muffler adapted for a catalyst having a granular support in which both the general design layout and the engineering details are optimized in order to fulfil the manifold and often mutually conflicting technical requirements, while concurrently solving in the most simple and economically acceptable way the considerable difficulties of construction occurring with devices of this kind.

In various parts of the present specification such difficulties and requirements will be indicated at the proper places, together with those design and layout approaches which, in the container suggested herein, have been selected in order that the above outlined optimization may be achieved.

A first selection is concerned with the exterior shape of the suggested container, which is, in its essence, that of a flattened cylinder with a large transversal cross-sectional area and a reduced height: as a matter of fact, the muffler must be arranged at a certain distance from the engine so as to prevent thermal and mechanical stresses (these latter being due to the vibrations of the engine) both to the catalyst granules and the container as such. In the predominant majority of the cases, especially for cars having a front engine, this means that the muffler should be arranged beneath the car floor, on taking into account the necessary distance from the ground, so as not to invade the inner space in the car, it is advisable that the muffler be flat and arranged parallely to the car floor.

In the interior of the container, also the catalyst bed has the shape of a flattened cylinder, with a large transverse cross-sectional area and a reduced height. By so doing, a muffler of this kind fulfils another requirement, too, that is, that of minimizing the pressure drop that the gases undergo when flowing across the catalyst bed, i.e. the mass of the granules. As a matter of fact, the gas flow is vertical and, inasmuch as the thickness of the bed is small relative to the diameter, and the circular flow cross-section for the gas is large (normally to the direction of flow), the velocity of the gas flow across the bed is also very small. Theoretical research and field tests have permitted to assess that optimum values for the ratio of the height to the diameter of the catalyst bed lie within a range of from 0.15 to 0.35.

Figure 1:
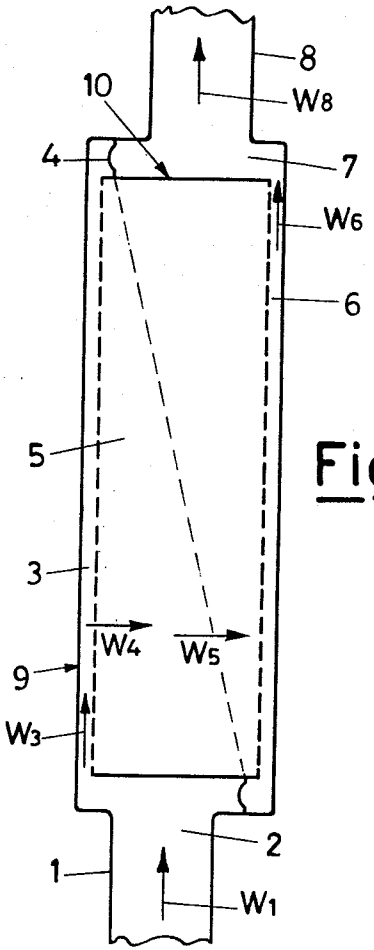

The foregoing and other features of the muffler according to the invention will become clearer from a scrutiny of FIGS. 1 and 2 in which a vertical cross-section and a transverse cross-section of the muffler according to the present invention are respectively shown.

The muffler has a container which comprises an outer shell, 9, of a cylindrical and flattened shape, an inner casing 10, also having a flattened cylindrical shape, with the circular walls fitted with ports for allowing the gas flow therethrough, and an annular partition wall, 4, sloping relative to the horizontal line, which acts as a supporting member for the interior casing within the outer shell.

The numeral 5 connotes the granular mass of catalyst as held within the inner casing 10 and 1 indicates the duct for the intake of the gases into the muffler, whereas 8 is the gas outlet duct of the muffler, both these ducts being integral with the outer shell 9.

The numeral 2 indicates an annular volume, having a decreasing height, which surrounds the catalyst bed, while 3 is a flattened cylindrical space which conveys the gases toward the catalyst bed: 6 is a flattened cylindrical volume into which the gases emerging from the catalyst bed merge, and 7 is a second annular space which surrounds the catalyst bed. Above and beneath the catalyst bed, the two cylindrical volumes 3 and 6, which convey, respectively, the gases entering the catalyst bed and those emerging therefrom, are characterized by a wide circular cross-sectional transversal area (equalling that of the catalyst bed) and by a very thin thickness, the latter being extremely small as compared with the diameter of the same circular cross-section and virtually constant. This is permitted by the fact that the flow of the gases which, from the volume 2, feeds the catalyst bed 5, is radial and centripetal and the flow of the gases in the volume 7 in which the gases flow out of the catalyst bed is radial and centrifuged. By so doing, where the rate of flow of the gases is at a maximum, that is peripherally, the flow passage cross-section (normal to the radial flow) is wide enough even with very thin thickness of the volumes, as outlined above.

Research work which has been carried out, has shown that an approach which is satisfactory from all the points of view is achieved by adopting a ratio of the thickness to the diameter of such volumes comprised between 0.01 and 0.04.

Even with a virtually constant thickness of the cylindrical volumes, the several annular flow passage sections, in correspondence with the different values of the radius, in the volume upstream of the catalyst bed, and proceeding from the periphery towards the center along the radius, are decreased as the local rates of flow are increased. In the volume downstream of the catalytic bed, proceeding from the center towards the periphery along the radius, the annular cross-sections are increased as the local rates of flow are increased. As a matter of fact, such local rates of flow vary along the radius (they are at a maximum at the periphery and virtually nil at the center), on taking into account the quantity of gas which progressively enters the catalyst bed or which emerges from such bed, respectively.

The foregoing shows that the cylindrical flattened shape of the muffler, which fulfils the requirement of bulk limitation but also that of minimizing the pressure drop which the gases undergo through the catalyst bed, is also made possible by the special internal design (a very flat cylindrical outline) of the feeding volume for the catalyst bed and by the capacity at the outlet from such a bed.

On account of what has been said regarding the proportional relationship between the localized rates of flow and the local flow cross-sectional areas corresponding to the various values of the radii, the obvious consequence is that the velocity of the radial flow for the gas is almost constant at all points of the inlet volume and is also constant at all the points of the outlet volume: the result is, due to the principle of conservation of energy, that, since the velocity is constant at all points, so constant is also the pressure: thus, the pressure differential between the portions upstream and downstream of the catalyst bed is likewise constant in all the portions of the catalyst bed itself.

The pressure differential being constant, obviously is also constant the velocity of the gas flow which runs in all areas through the catalyst bed.

Thus, another requirement of an essential nature is fulfilled, that is, that of a homogeneous and thus complete exploitation of the entire catalyst bed throughout, in the sense that, through the bed, no preferential flow lines are established in certain areas and scanty or zero flows in other areas. On taking into account the importance of the stay time of the gases in contact with the catalyst to the ends of the oxidation reaction, and that such a stay time coincides with the time of flow through the bed, it will be understood that the constancy of the velocity of the gas flow in all areas of the catalyst bed, a characteristic feature of the muffler suggested herein, is an essential in order to optimize the conversion efficiency of the muffler.

It should be observed that a similar result (constant pressure at the inlet and at the outlet of the catalyst bed) could be obtained by arranging two spaces having a large volume upstream and downstream of such a bed. In such spaces the velocity of the gases would be virtually nil and the pressure would be maintained almost constant (due to the equation of conservation of energy, it is $p/\gamma + w^2/2g = K$). This approach, however, would not be such as to prevent two drawbacks: a larger bulk of the muffler both radially and vertically along with high pressure drops of the gases between the muffler inlet and the muffler outlet.

On the basis of the foregoing, it is apparent that the possibility of obtaining a constant-velocity flow (and thus a constant-pressure flow) in all the points of the cylindrical conveying inlet volume and of the cylindrical conveying outlet volume, and also the possibility of minimizing the thicknesses of such volumes, will exist only if the catalyst bed and the volumes in question have the shape of a cylinder with a circular base, as in the muffler disclosed herein: such possibilities are no existent with a square or a rectangular base.

In the catalytic muffler disclosed herein the gases arrive at the inlet peripheral section of the cylindrical inlet conveying volume, in which the flow is radial and centripetal, by flowing through an annular conveying duct which is connected to the inlet pipe of the catalytic muffler. Likewise, the gases flow from the peripheral outlet section of the cylindrical conveying outlet volume in which the flow is radial but centrifugal, to a second annular conveying duct which is connected with the outlet pipe of the catalytic muffler. Both these conveying ducts are arranged annularly around the catalyst bed, so that no increase in the muffler height derives with respect to the sum of the thickness of the catalyst bed with the thicknesses of the two cylindrical inlet and outlet conveying volumes to and from the bed.

Also as far as the size of the annular conveying ducts is concerned, in a preferred embodiment, they have been so constructed as to have a uniform pressure trend. Inasmuch as along the path of the gases through the inlet conveying duct the local rate of flow of the gases is decreased starting from the inlet sections (relative to the rates of flow of gases which are progressively fed in radial direction to the cylindrical inlet conveying volume), the sections of the conveying duct which are normal to the flow are also caused to be decreased, and the velocity of the gases is kept constant all along the conveying duct. The result is that along the inlet conveying duct the pressure is maintained virtually constant. Likewise, the cross-sections of the outlet conveying ducts normal to the direction of flow are caused to be increased as the local rate of flow is increased, and also all along said outlet conveying duct the pressure remains constant. This additional constructional detail obviously contributes towards affording the constancy of the pressure differential in all the cross-sections of the catalyst bed.

It has been said above that in the catalytic muffler suggested herein the pressure drops are minimized, which the gas undergoes when flowing through the catalyst bed by reducing the thickness of said bed and also reducing the velocity of the flow therethrough (wide flow passage section). In order that also the pressure drops may be minimized, that the gas undergoes while flowing through the other portions of the muffler (ducts and conveying volume of the gas) there has been adopted, in the muffler according to this invention, the criterion of confining the gas velocity within acceptable values also in these ducts and volumes, since the pressure drops are increased as a function of the square power of the velocity. Another criterion, however, has been concurrently adopted, due to the fact that the velocity of the gas in the ducts upstream of the muffler is generally high (to reduce the weight, the bulk and also the noisiness of the ducts); in the interior of the muffler, and exactly in the annular inlet conveying duct and its next cylindrical conveying volume, the transition must take place from such high velocity upstream, to the very slow velocity of flow through the catalyst bed.

In order to recover the majority of the initial kinetic energy, the fact has been taken into account that, when passing abruptly from a higher to a lower speed, the percentage recovery of the kinetic energy is greater if the ratio of the two velocities is not high. It is thus an asset that such a ratio is not high when the first of the two velocities is high inasmuch as, apparently, the amount of the kinetic energy to be recovered is smaller.

If, with reference to the diagrammatical drawing FIG. 1, $w_1$ and $A_1$ indicate the velocity and the flow cross-section in the duct 1 upstream of the muffler, and $w_2$ and $A_2$ are the velocity and the cross-sectional area on inlet into the annular conveying duct 2, $w_3$ and $A_3$ are the velocity and the inlet cross-sectional area of the cylindrical conveying volume 3, $w_4$ and $A_4$ are the velocity and the corresponding flow passage area through the ports of the inlet walls of the catalyst container, $w_5$ and $A_5$ are the velocity and the cross-sectional passage area through the catalyst, on the basis of the concepts expounded above, in the catalytic muffler of this invention, the following relationship is valid:

$$w_1/w_2 < w_2/w_3 < w_3/w_4 \leqq w_4/w_5,$$

since, obviously, it is:

$$w_1/w_5 = w_1/w_2 \text{ by } w_2/w_3 \text{ by } w_3/w_4 \text{ by } w_4/w_5$$

What has been said just now can be expressed in geometrical terms, thus:

$$A_2/A_1 < A_3/A_2 < A_4/A_3 \leqq A_5/A_4$$

One of the most serious problems to be solved in the construction of the container is the considerable thermal stresses to which the structure is subjected as a consequence of the very high temperatures of the gases flowing therethrough. The correct operation of the muffler and its service life also depend, to a degree, from the technological concepts adopted for its construction. It should be borne in mind that the different parts of the muffler are subjected to different working temperatures: the inner walls which are swept by the gases on both surfaces are brought, in fact, to the same temperature of the gases, whereas the outer walls (swept by the gases on a surface and by the external air on the other surface) are much colder, but also the several inner walls are not all at the same temperature, and this also because the temperature of the gases is not the same everywhere (because it is in more or less close contact with outer walls, because the postcombustion increases their temperature and many other reasons).

To prevent distortions and also breakages of the sheet metal due to the stresses induced by the expansion differential which would occur, an embodiment of the invention aims at enabling the several component parts to expand in different ways. On account of this case, in the muffler according to this invention, above all, the inner casing of the catalyst is made by assembling the two base circular walls and the cylindrical sidewall without resorting to any welding. The two circular walls have their edges curled vertically so as to be capable of being slipped with a certain circumferential clearance onto the cylindrical sidewall. The two base circular walls of the outer shell have a set of projections arranged along two circles having a diameter equal to that of the cylindrical wall of the container. By so doing, after that the inner casing of the catalyst has been assembled, it is inserted into the outer shell and the circular walls are maintained in contact with the edges of the cylindrical walls by the agency of the projections aforementioned. Between the mutually contacting walls a sufficiently tight seal is obtained so as to prevent the escape of catalyst granules.

To assemble the inner casing of the catalyst, there can also be employed, in addition to, or as an alternative to the approach disclosed herein, tongues with their ends welded to the circular walls and to the cylindrical wall of the same inner casing and with the central portion properly corrugated so as to permit to the three walls different radial and axial expansions.

Still with a view to enabling the several component parts to be freely expanded in different manners, the inner casing of the catalyst is connected to the outer shell by an annular partition wall having its surface circumferentially corrugated. Inasmuch as the outer shell of the muffler is composed by two cylindrical half-shells welded to one another along their edges, the same edges of the two half-shells have, welded thereto, the outer edge of the annular partition wall.

In addition to that, in order to prevent uncontrolled distortions of the metal sheets, the circular walls of the catalyst container end of the outer shell are slightly crowned, all with the same curvature. By such a configuration of the walls, the deformation of the metal sheets, due to a temperature differential and thus to a different expansion along the radius, is guided in a determined direction which is identical for all the walls so that these remain substantially parallel in any case.

The muffler according to the present invention is thus constituted by an outer shell of sheet metal having essentially the shape of a flattened cylinder, with a circular base, arranged with its axis essentially vertical, and is composed by an inner casing of sheet metal filled with granules of a catalyst, also having the shape of a flattened cylinder, with a diameter and a height somewhat lower than those of the outer shell, the muffler comprising, in addition, an annular partition wall of sheet metal having its inner edge welded to the cylindrical wall of the inner casing and its outer edge welded to the cylindrical wall of the outer shell in such a way that the inner casing is arranged coaxially and also in an axially centered position relative to the outer shell, the exhaust gases flowing in the interior of the muffler by passing sequentially through five spaces, the third space being formed by the aforementioned inner casing in the form of a flattened cylinder containing the catalyst granules, the second and the fourth spaces having also the shapes of flattened cylinders, with their diameters equalling that of the third space and with a height which is very reduced relative to the same diameter, the second space being superposed to the third space and being confined at the top and at the bottom by the upper circular walls of the outer shell and of the inner casing, the fourth space being arranged beneath the third space and being confined at the top and at the bottom by lower circular walls of the inner casing and by the outer shell, the first and the fifth spaces being of an annular form, superposed the one to the other and being coaxial and arranged around the second, the third and fourth spaces, the first and the fifth spaces being substantially confined by the wall of the annular partition wall and by the cylindrical sidewalls of the outer shell and of the inner casing, the first space being arranged above said annular partition wall, the fifth space being arranged beneath said annular partition wall, the flow of the gas in the first and the fifth spaces being substantially circular, it being substantially radial in the second and fourth spaces and only axial in the third space, the first space, of annular shape, and the second space, of cylindrical flattened shape, having the task of conveying the gases towards the third space as constituted by said inner casing which contains the catalyst granules, the fourth space, of a flattened cylindrical shape, and the fifth space, of an annular shape, having the function of manifolds of the gases emerging from the third space, the first space being fitted with an inlet duct for the gas into the muffler in correspondence with an inlet port as formed through the cylindrical wall of the outer shell, the fifth space being equipped with an outlet duct for the gases from the muffler in correspondence with an outlet port as formed through the cylindrical wall of the outer shell, said outer shell being composed by two half-shells of stamped sheet metal comprising a circular base and a cylindrical sidewall, the edges of the two half-shells being welded to one another and being also welded to the outer edge of the annular partition wall, the inner casing being composed by a first circular wall, virtually planar and equipped with ports which make the gas flow possible, by a cylindrical wall and by a second circular wall, virtually planar and equipped with ports which make the gas flow possible, the circular walls being equipped with vertically curled edges so as to be slipped with a certain circumferential clearance onto the outside of the cylindrical wall, fastening means being provided to hold said circular walls in contacting relationship with the edges of said cylindrical wall.

Figure 4:
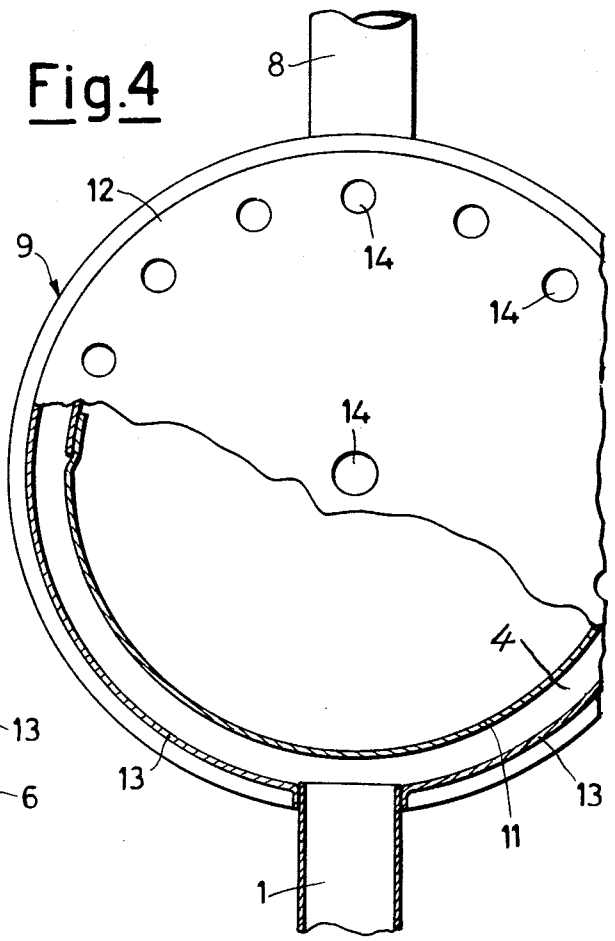
Figure 3:
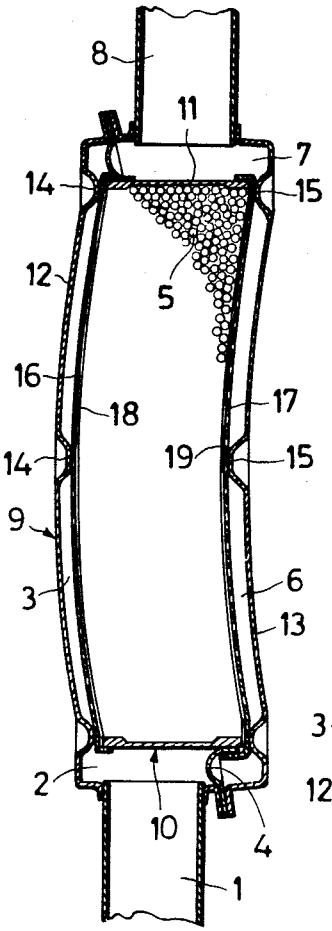

FIGS. 3 and 4 show a muffler constructed according to the structural ideas set forth hereinabove. In these FIGURES, the component parts corresponding to those of the muffler of FIGS. 1 and 2 have the same reference numerals, as illustrated in the foregoing in order to show the characteristics of its structure.

The outer shell 9 of the muffler is constituted by two half-shells 12 and 13 with their cylindrical sidewalls having decreasing heights; to the upper half-shell 12 the gas inlet duct 1 is connected, while the lower half-shell is connected to the duct 8 which conveys the gases out of the muffler.

As viewed in FIG. 3, the circular bottom walls 12 and 13 of the two half-shells are slightly crowned according to the same radius of curvature, in order to direct towards a preselected direction the deformation that the same walls undergo due to heat stresses.

The walls 12 and 13 are equipped with a set of embossments 14 and 15, which are arranged along circumferences having a diameter equal to that of the cylindrical sidewall of the inner casing 10 and in correspondence with the axis of the same casing. These embossments support said casing axially.

The inner casing 10, which contains the catalyst granules 5, is constituted by the cylindrical sidewall 11 and by the bottom circular walls 16 and 17 foraminous sheet metal. Two wire gauzes 18 and 19, respectively, having a close woven texture, shield the foraminous sheet metal walls so that a direct contact is prevented between the catalyst granules and the foraminous sheet metal walls. The adherence of the wire gauze to the foraminous sheet metal can be strengthened by local stitching points of thin steel wire.

The circular walls of the inner casing 10 have their surfaces crowned with a radius of curvature which is identical to that of the bottom walls of the outer shell 9: in addition, they have their edges curled vertically so as to be slipped with a certain circumferential clearance onto the cylindrical sidewall 11 of the same casing 10. The cylindrical sidewall 11 has, in the vicinity of its edges, two portions of enlarged thickness with which the circular walls of the inner casing are kept into contact by the agency of the embossments 14 and 15 of the bottom walls of the outer shell upon the assemblage of the muffler. In correspondence with the inner edge of the cylindrical wall 11, there is welded, to such wall, the annular partition wall 4, which is circumferentially corrugated. The partition wall 4 is arranged on the same plane, sloping relative to the horizontal, on which lie the edges of the two-half-shells 12 and 13 and is welded to such edges of the two half-shells in correspondence with its outer edge.

In the muffler as shown herein, the ratio of the height to the diameter in the inner casing 10 which contains the catalyst, is 0.29 and the ratio of the height to the diameter of the cylindrical spaces 3 and 6 is 0.021.

Figure 5:
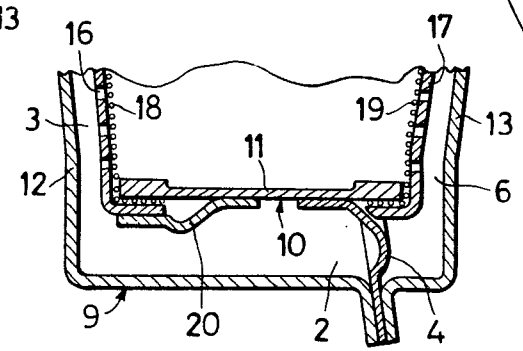

In FIG. 5, a modification is shown of the muffler of FIG. 3 in which the circular bottom walls of the outer shell have no embossments such as 14 and 15 and the function of supporting the catalyst bed 10 within the outer shell is entrusted to the annular partition wall only.

Thus, in this case, the connection between the circular bottom wall and the cylindrical sidewall of the outer shell 10 which contains the catalyst 5 is obtained by the agency of a set of tabs 20 which have their ends welded to the circular walls 16 and 17 and to the cylindrical wall 11. The tabs have a bend in correspondence with their central portion so as to allow for different both axial and radial expansions of the inner casing.

What we claim is:

1. A catalytic muffler for an exhaust duct of an internal combustion engine of a motor vehicle, including:

(a) an outer casing in the shape of a substantially flattened cylinder, having reduced height with respect to the diameter and having a substantially vertical axis, said casing being defined by an assembly of an upper and a lower sheet metal half-shells connected to one another in a sealed tight manner along a line lying on the outer cylindrical surface and on a plane inclined with respect to the vertical axis, each half-shell being defined by only one piece of metal sheet and including an essentially planar wall of circular outline and a cylindrical side wall, of a height gradually decreasing and having a free edge lying on said inclined plane, (b) a first gas inlet duct connected to the cylindrical side wall of the upper half-shell at the zone thereof of greatest height, (c) a second gas discharge duct connected to the cylindrical side wall of the lower half-shell at the zone thereof of greatest height, (d) a catalyst containing inner casing, having also substantially the shape of a flattened cylinder, namely reduced height with respect to the diameter thereof, mounted in the interior of the outer casing and coaxial therewith, a side annular wall of the inner casing being gas impervious, while upper and lower circular walls of the same are permeable to the gas, whereby the flow of the gases through the catalyst takes place predominantly along a direction which is substantially parallel to the vertical axis of the inner casing, said circular walls being provided with vertically curled edges slipped with circumferential clearance around corresponding edges of said annular wall, means being provided to hold said circular walls in yieldable contact relationship with said annular wall, (e) a wall having inner and outer edges, said wall having an annular shape and being of corrugated metal sheet lying on the same inclined plane of the edges of said half-shells, the inner edge of said annular corrugated wall being connected to the side annular wall of the inner casing, the outer edge of the corrugated annular wall being connected to the edge of said half-shells, (f) a chamber defined by the walls of the upper half-shell, the walls of the inner casing and the annular corrugated wall, said chamber communicating with said inlet duct and serving as a manifold for conveying the gases towards the upper circular wall of the inner casing, said chamber including an annular capacity positioned above said annular corrugated wall, said capacity having decreasing height, which is equal in every point to the height of the cylindrical side wall of the upper half-shell and further including a capacity positioned above the inner casing and having a cylindrical flattened shape, namely having a diameter like that of said inner casing and height much lower than the diameter, and (g) a chamber defined by the walls of the lower half-shell, the walls of the inner casing and the annular corrugated wall, said chamber communicating with the discharge duct and serving as a manifold for the gases coming out of the lower circular wall of the inner casing, said chamber comprising an annular capacity positioned under the annular corrugated wall, said capacity having increasing height, which in every point is equal to the height of the cylindrical side wall of the lower half-shell, and further including a capacity positioned below the inner casing and having a cylindrical flattened shape, namely having a diameter equal to that of the inner casing, but of very reduced height with respect to the diameter.

2. A muffler according to claim 1, characterized in that said upper and lower circular walls of the inner casing are constituted by a foraminous sheet metal wall and by a wire gauze connected to one another in correspondence with the periphery.

3. A catalytic muffler according to claim 1, characterized in that said upper and lower circular walls of the inner casing are crowned somewhat, the trend of the crowning being substantially parallel and in that similarly and with an essentially parallel trend also the circular walls of the two half-shells which constitute the outer shell are crowned.

4. A muffler according to claim 1, wherein said means for holding said circular walls of the inner casing in yieldable contact with said annular wall comprise embossments directed downward and integral with the circular wall of the upper half-shell of the outer shell and arranged spaced apart from one another along a circumference having a diameter nearly equal to that of the cylindrical wall of the inner casing and similar upward directed embossments integral with the circular wall of the lower half-shell, the embossments integral with the upper half-shell being in contacting relationship with said upper circular wall of the inner casing whereas the embossments integral with the lower half-shell are in contacting relationship with said lower circular wall of said inner casing.

5. A catalytic muffler according to claim 1 wherein said means for holding said circular walls of the inner casing in yieldable contact with said annular wall comprise sheel metal tongues bound at either end to the outer surface of said cylindrical wall of the inner casing, and at the other end they are bound to one of said upper and lower circular wall of the same inner casing, the tongues being equipped with a bend which permits different expansions in radial and axial direction of the three walls which make up the inner casing.

6. A muffler according to claim 1, characterized in that the ratio of the height to the diameter of the inner casing aforesaid is comprised between 0.15 and 0.35.

7. A muffler according to claim 1, characterized in that the ratio of the thickness to the diameter of the second and the third spaces is comprised between 0.01 and 0.04.

* * * * *